United States Patent [19]

Wilson

[11] 4,133,163

[45] Jan. 9, 1979

[54] PACKAGING MACHINES

[75] Inventor: Peter G. Wilson, Leeds, England

[73] Assignee: Baker Perkins Holdings Limited, Peterborough, England

[21] Appl. No.: 803,377

[22] Filed: Jun. 3, 1977

[51] Int. Cl.[2] ..... B65B 31/02; B65B 11/52

[52] U.S. Cl. ..... 53/52; 53/141; 53/511

[58] Field of Search ..... 53/112 A, 141, 52; 425/388

[56] References Cited

U.S. PATENT DOCUMENTS

| | | | |
|---|---|---|---|
| 3,072,961 | 1/1963 | Gilbert | 425/388 |
| 3,314,110 | 4/1967 | Missbach | 425/388 |
| 3,897,675 | 8/1975 | Wilson | 53/112 A |
| 3,910,008 | 10/1975 | Johnson | 53/112 A |

*Primary Examiner*—Travis S. McGehee

*Attorney, Agent, or Firm*—Watson, Cole, Grindle & Watson

[57] ABSTRACT

A skin packaging machine for the continuous production of air-free skin packages comprising a suction box, a perforated conveyor for traversing over the suction box an imperforate lower web of thermoplastic material carrying spaced articles to be packaged, means for feeding a heated imperforate upper web of thermoplastic material towards the lower web and guiding its edges into contact with the upper surface of the lower web as the latter travels over the suction box and a thermoforming unit, disposed between a supply reel for the lower web and the conveyor, which is operative to impose a dimpled upper surface on the lower web, said thermoforming unit being constituted by a heated drum and an adjoining thermoforming drum around both of which the lower web is passed, and the thermoforming drum having an air-permeable and dimpled peripheral surface and including means for applying suction to the interior thereof.

7 Claims, 11 Drawing Figures

PACKAGING MACHINES

In U.S. Pat. No. 3,897,675, I have described and claimed a skin packaging machine for the continuous production of air-free skin packages comprising a suction box, a perforated conveyor for traversing over the suction box a lower imperforate web of thermoplastic material having a dimpled upper surface and carrying spaced articles to be packaged, and means for feeding a heated upper imperforate web of thermoplastic material and guiding its edges into contact with the upper surface of the lower web as the latter travels over the suction box.

In operation of this machine the suction applied by the suction box exhausts air from between the webs to cause the webs to become sealed together in the areas surrounding the articles and the upper web to make close contact with the article.

In the machine described and illustrated in said specification an undimpled lower web is fed to the conveyor, the centre section of the conveyor has a dimpled surface for imposing the dimpled surface on the lower web and a heater is provided for heating the lower web on its way to the suction box.

The present invention provides a modification of the machine claimed in U.S. Pat. No. 3,897,675 in which the dimples are imposed on the lower web during its travel from a supply reel to the conveyor by passage of the lower web around a heated drum and around another adjoining drum having an air-permeable and dimpled peripheral surface and to the interior of which suction is applied.

Thermoforming of the lower web to produce the dimpled surface thereon is thus effected by a separate unit. The control of the heating and thermoforming conditions, which may include cooling of the web by cooling air while on the dimpled drum, can be more precisely controlled than when, as in said Specification, the dimpling is performed by a specially manufactured conveyor belt. The conveyor belt can be of simplified construction and consists of a conventional belt with rows of perforations adjacent the edges of the lower web. If a different form of dimpling is required, this can be effected by replacing the thermoforming drum by one having a different surface pattern and there is no need to make any change in the conveyor belt.

Figure 1:
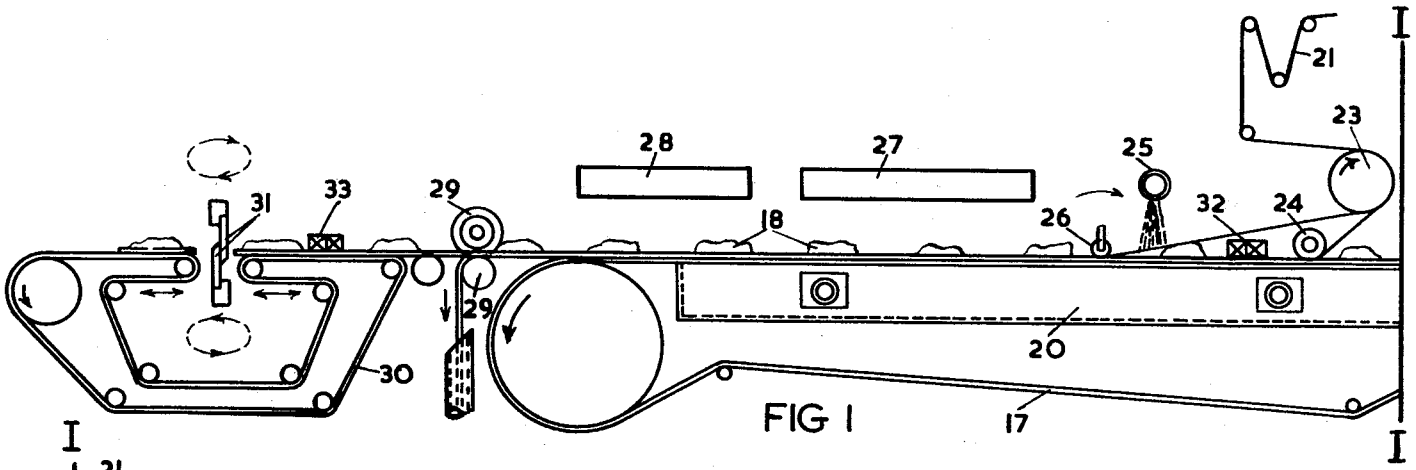
Figure 2:
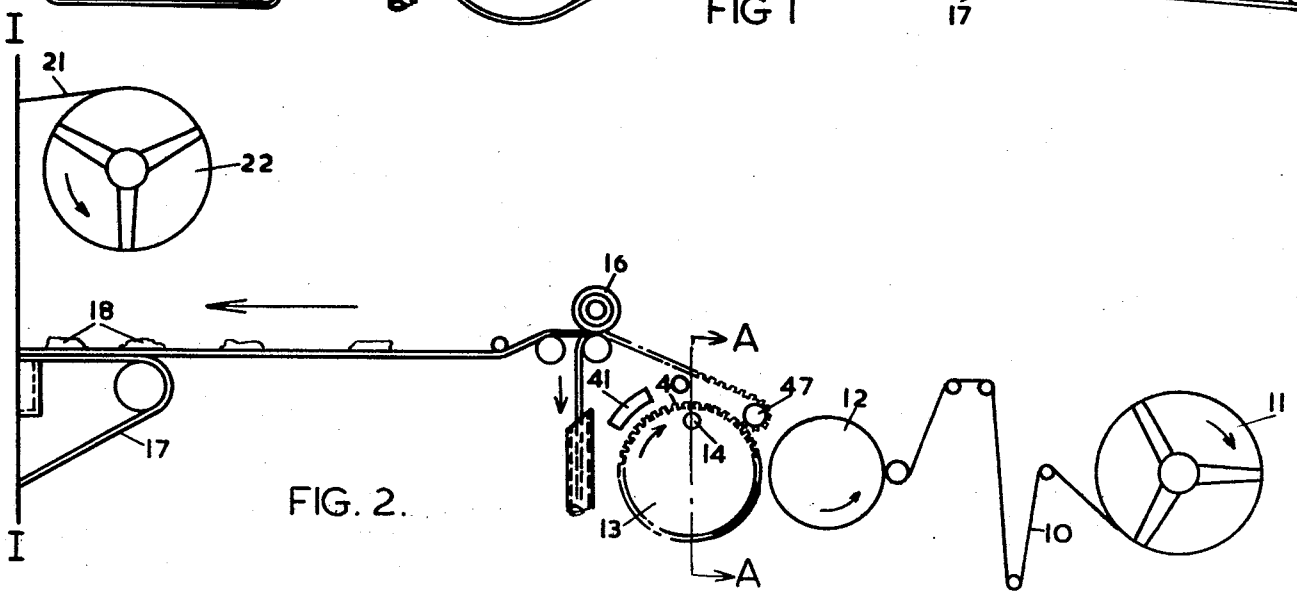
Figure 3:
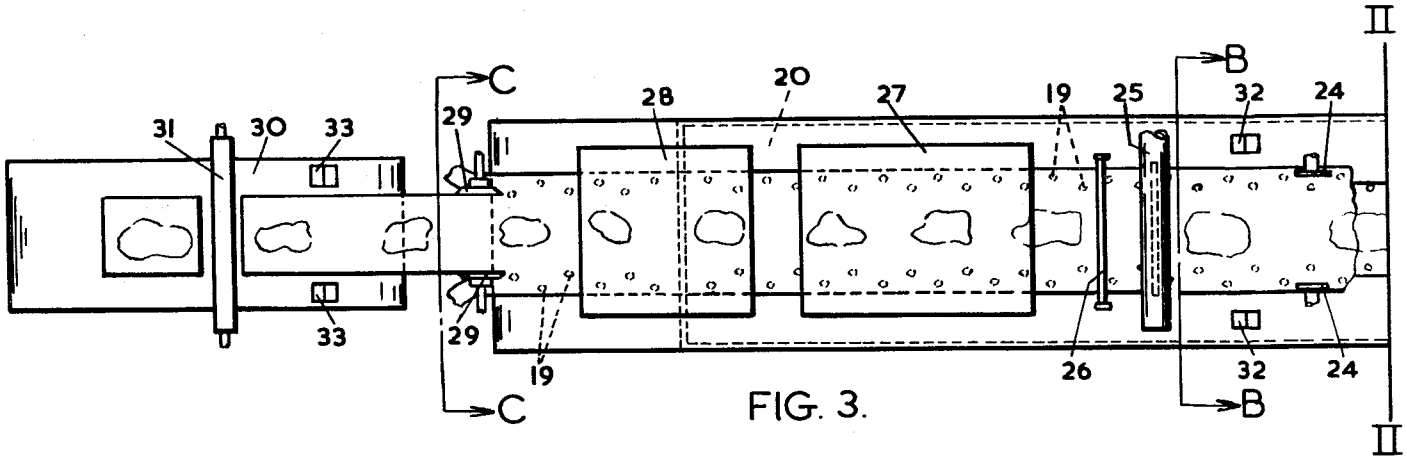
Figure 4:
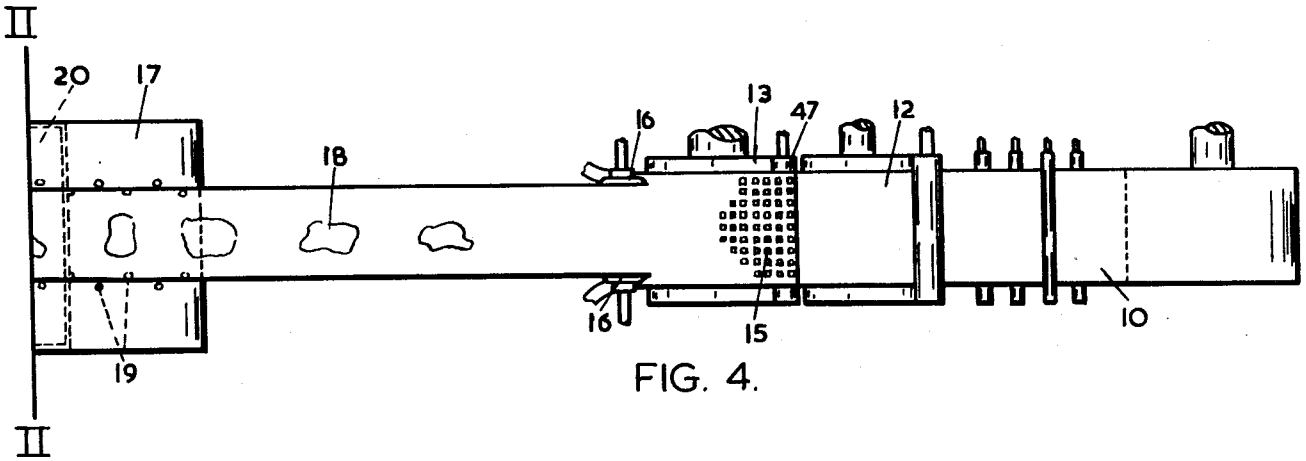
Figure 5:
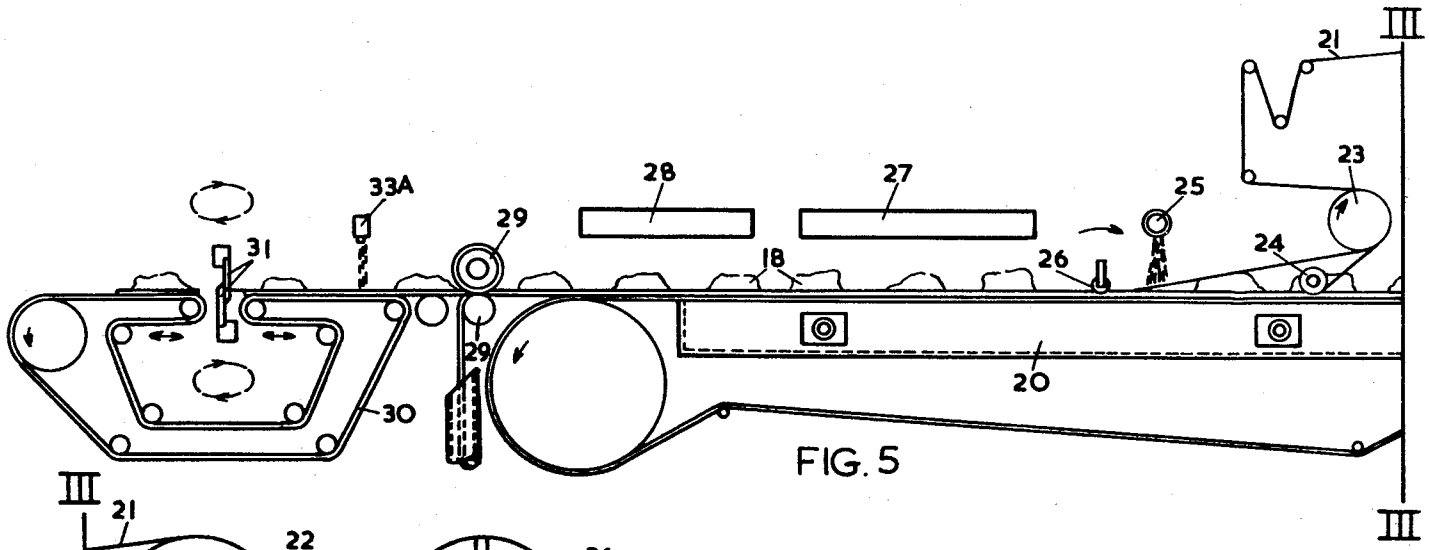
Figure 6:
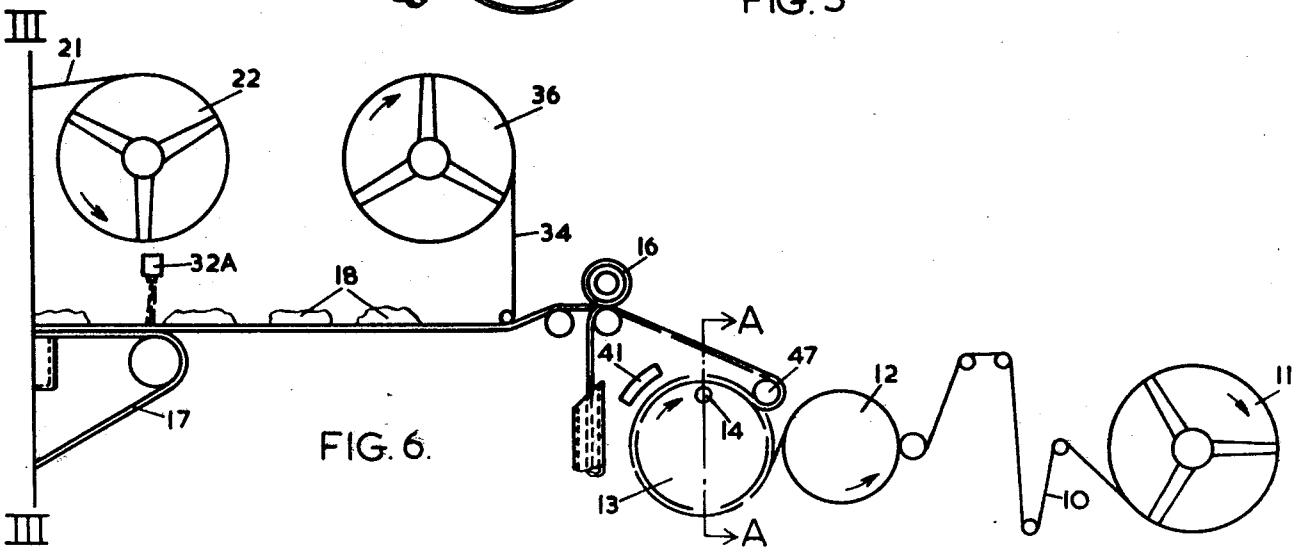
Figure 7:
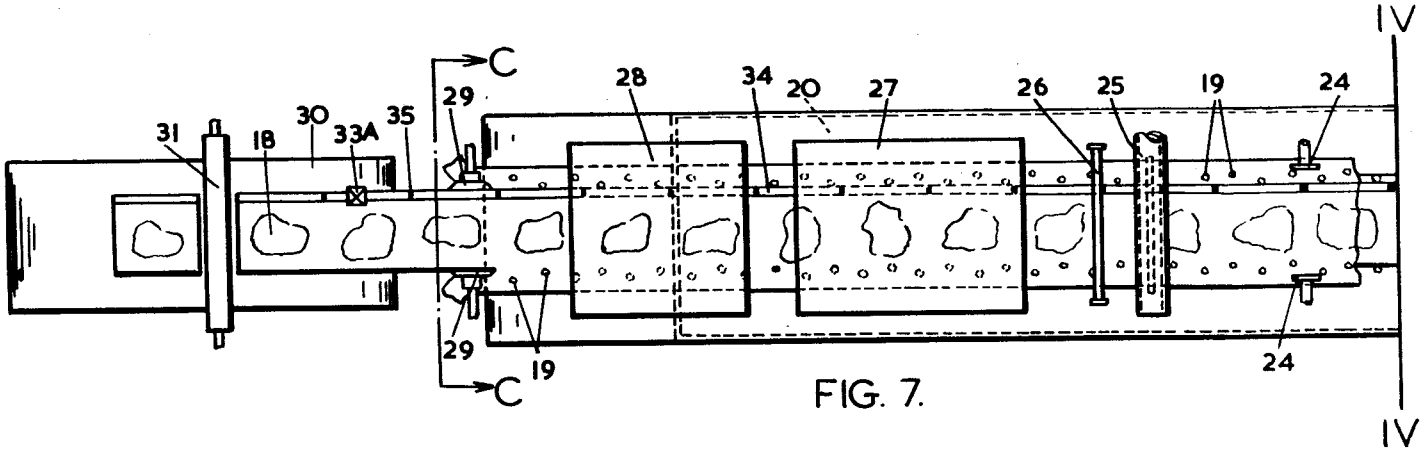
Figure 8:
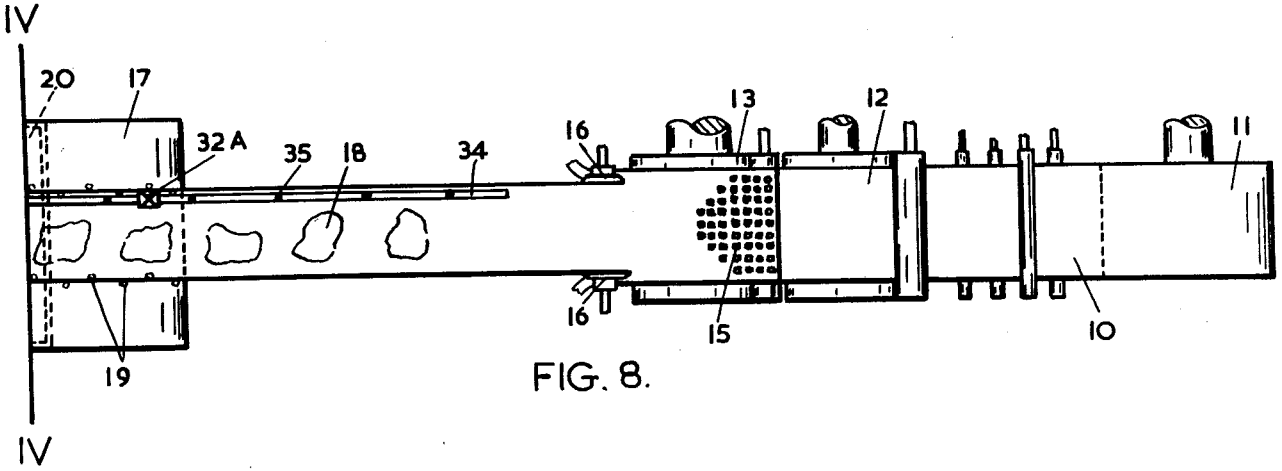
Figure 9:
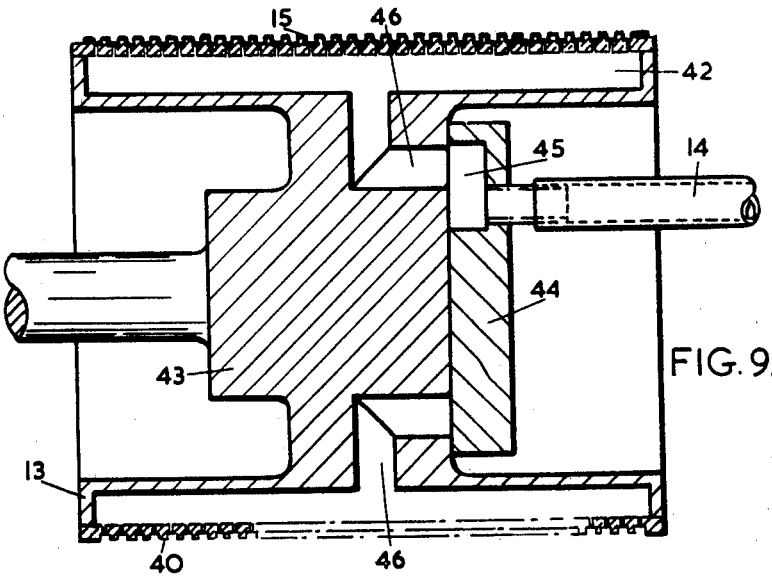
Figure 10:
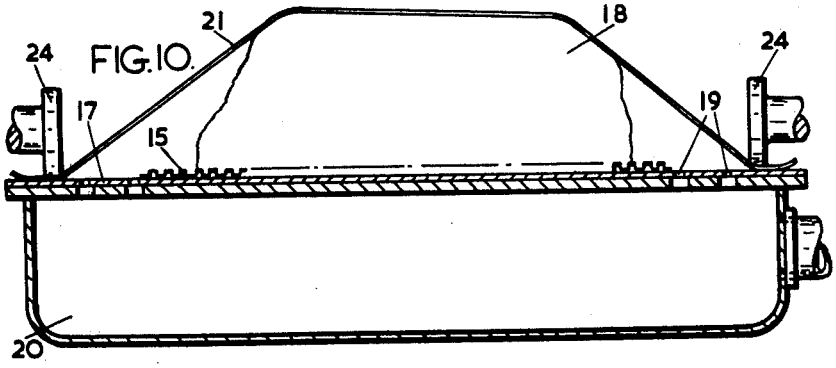
Figure 11:
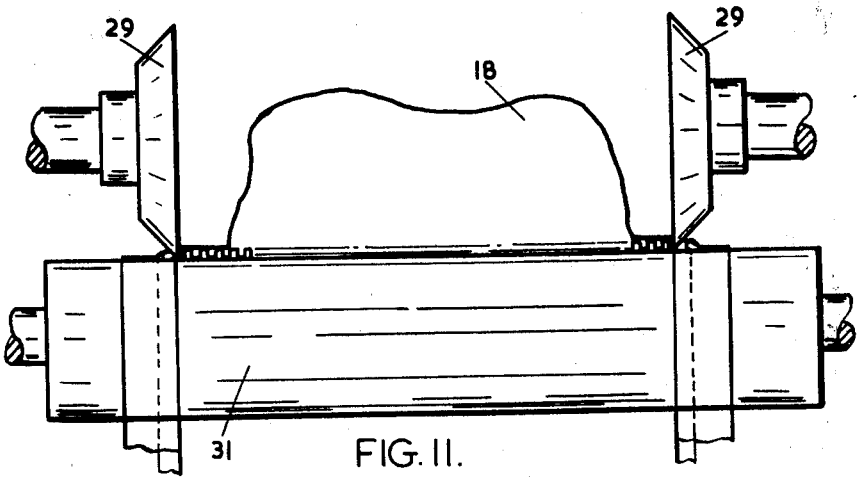

Two embodiments of skin packaging machine according to the invention are illustrated, by way of example, in the accompanying diagrammatic drawings, in which:

FIGS. 1 and 2, which adjoin at the line I—I, constitute a side elevation of the first embodiment, FIGS. 3 and 4, which adjoin at the line II—II, constitute a corresponding plan view, FIGS. 5 and 6, which adjoin at the line III—III, constitute a side elevation of the second embodiment, FIGS. 7 and 8, which adjoin at the line IV—IV, constitute a corresponding plan view, and FIGS. 9, 10 and 11 are respectively sections on a larger scale on the lines A—A in FIGS. 2 or 6, on the line B—B in FIG. 3 and on the line C—C in FIG. 3.

Like reference numerals denote like parts throughout the Figures.

As shown in FIGS. 1 to 4, an undimpled lower web of thermoplastic material 10 is fed from a reel 11 around a drum 12, containing an internal heater (not shown), and then around an adjoining thermoforming drum 13, which has a dimpled and perforated peripheral surface 40 of expanded metal. The drums 12, 13 are rotated, by means not shown, in the directions indicated by the arrows in FIG. 2 and a cooling fan 41 provides for cooling of the portion of the web on the surface of the drum 13. As shown in FIG. 9, the drum 13 has an annular internal suction chamber 42 beneath its peripheral surface 40 and a hub 43 which contacts a stationary suction shoe 44. Suction is applied from a suction pipe 14 to the chamber 42, and thence to the perforations 40 in the surface of the drum 13, via ports 45, 46 in the shoe 44 and in the hub 43.

The peripheral surface 40 of the drum 13 forms on the web 10, which has been heated by passage around the roller 12, a dimpled surface 15. The thermoformed web 10 passes from the drum 13, over a roller 47, to a pair of edge trimming knives 16.

The web 10 then passes to a conveyor belt 17 over a stationary plate (not shown), articles 18 to be packaged being placed at intervals upon it as it travels towards the belt. As shown in FIG. 3, the belt 17 has near each edge two rows of perforations 19. The belt 17 carriers the web 10, and the articles 18 on it, over a suction box 20 and the suction applied to the inner rows of perforations holds the web 10 to the belt 17.

An upper web 21, which is wider than the trimmed lower web 10, is fed from a reel 22 over a heated drum 23 and thence to control rollers 24 which press its edges against the belt 17, the upper web being thereafter held down by suction through the outer rows of perforations 19 in the belt. Beyond the rollers 24 further heat is applied to the upper web by a hot air blower 25.

A rotary clamp 26 operates to press the upper web 21 against the lower web 10 after each article has passed the clamp and beyond this point the suction applied by the suction box 20 through the perforations 19 draws the upper web 21 into skin tight contact with the upper surfaces of the articles 18 as shown in FIG. 10. As more fully described in U.S. Pat. No. 3,897,675 the suction box 20 is effective to draw air from the enclosure formed by the two webs owing to dimpled formation of the upper surface 15 of the web 10.

Beyond the clamp 26 is a radiant heater 27 which maintains the upper web 21 in a plastic state until the skin packaging operation is completed as shown in FIG. 11. The packages then pass beneath a cooler 28 and the edges of the upper web 21 are trimmed by knives 29. The superposed webs 21, 10 then pass onto a further conveyor 30 and are severed between the articles 18 by knives 31 to produce individual packages.

In the embodiment shown in FIGS. 1 to 4, the clamp 26 and the knives 31 are triggered by respective photoelectric cells 32, 33 which sense the approach of successive articles.

The embodiment shown in FIGS. 5 to 8 differs only in that a printed paper strip 34, bearing regularly spaced registration marks 35, is fed from a reel 36 onto one edge of the lower web and the photoelectric cells 32A, 33A which control the rotary clamp 26 and the knives 31 sense the registration marks 35 on the strip 34.

What I claim as my invention and desire to secure by Letters Patent is:

1. A skin packaging machine for the continuous production of air-free skin packages comprising a suction box, a perforated conveyor for traversing over the suction box an imperforate lower web of thermoplastic material carrying spaced articles to be packaged, means for feeding an imperforate upper web of thermoplastic material towards the lower web, means for guiding the edges of the upper web into contact with the upper surface of the lower web as the latter travels over the suction box, means for heating said upper web prior to contact thereof with said lower web, a clamp disposed above said suction box, said clamp being operative periodically to press said webs between said articles, and a thermoforming unit, disposed between a supply reel for the lower web and the conveyor, which is operative to impose a dimpled upper surface on the lower web, said thermoforming unit being constituted by a heated drum and an adjoining thermoforming drum around both of which the lower web is passed, and the thermoforming drum having an air-permeable and dimpled peripheral surface and including means for applying suction to the interior thereof.

2. A machine as claimed in claim 1, which includes a cooling fan for cooling the portion of the lower web on the surface of the thermoforming drum.

3. A machine as claimed in claim 1, which includes, beyond the suction chamber, knives for severing the superposed webs between the articles to produce individual packages.

4. A machine as claimed in claim 3, which includes photoelectric cells for controlling the clamp and the knives in response to approach of successive articles.

5. A machine as claimed in claim 1, which includes means for feeding a strip bearing regular spaced registration marks onto one edge of the lower web prior to arrival of the lower web on the conveyor, a rotary clamp operative to press the webs together between successive articles, knives disposed beyond the suction box for severing the superposed webs between the articles and photoelectric cells responsive to said registration marks for controlling the clamp and the knives.

6. A machine as claimed in claim 1, which includes means for blowing hot air on to said upper web at a location between said edge guiding means and said clamp.

7. A skin packaging machine for the continuous production of air-free packages comprising a suction box, a perforated conveyor for traversing over the suction box an imperforate lower web of thermoplastic material carrying spaced articles to be packaged, means for feeding an imperforate upper web of thermoplastic material towards the lower web, means for guiding the edges of the upper web into contact with the upper surface of the lower web as the latter travels over the suction box, means for heating said upper web prior to contact thereof with said lower web, a clamp disposed in the path of travel of said webs and operable to press said webs together between successive articles, means for heating said upper web prior to contact thereof with said lower web, a thermoforming unit, disposed between a supply reel for the lower web and the conveyor, which is operative to impose a dimpled upper surface on the lower web, said thermoforming unit being constituted by a heated drum and an adjoining thermoforming drum around both of which the lower web is passed, the thermoforming drum having an air-permeable and dimpled peripheral surface and including means for applying suction to the interior thereof, means for feeding a strip bearing regular spaced registration marks onto one edge of said lower web prior to arrival of the lower web on said conveyor, knives disposed beyond the suction box for severing the superposed webs between the articles and photoelectric cells responsive to said registration marks for controlling the clamp and the knives.

* * * * *